United States Patent [19]

Neisen

[11] Patent Number: 4,557,695

[45] Date of Patent: Dec. 10, 1985

[54] NO-FEEDBACK STEERING SYSTEM FOR MARINE DRIVES

[75] Inventor: Gerald F. Neisen, Oshkosh, Wis.

[73] Assignee: Brunswick Corp., Skokie, Ill.

[21] Appl. No.: 454,357

[22] Filed: Dec. 29, 1982

[51] Int. Cl.[4] ..... B63H 21/26

[52] U.S. Cl. ..... 440/53; 114/144 R; 440/55

[58] Field of Search ..... 114/144 R, 162, 172, 114/150; 440/51–53, 55, 62, 63, 61; 244/224, 78; 188/300; 74/470, 496; 91/437, 466

[56] References Cited

U.S. PATENT DOCUMENTS

| | | | |
|---|---|---|---|
| 3,228,632 | 1/1966 | Hunth | 244/224 |
| 4,013,249 | 3/1977 | Meyer et al. | 440/61 |
| 4,227,481 | 10/1980 | Cox et al. | 114/144 R |
| 4,349,341 | 8/1982 | Morgan et al. | 440/51 |

FOREIGN PATENT DOCUMENTS 911722 11/1962 United Kingdom .

*Primary Examiner*—Trygve M. Blix

*Assistant Examiner*—Edwin L. Swinehart

*Attorney, Agent, or Firm*—Andrus, Sceales, Starke & Sawall; Wm. G. Lawler, Jr.; O. T. Sessions

[57] ABSTRACT

A steering system for a steerable marine drive has a fluid filled cylinder with the housing connected to the boat and the piston connected to the steering arm of the marine drive. The piston contains valves operated by the control cable connected to the steering wheel of the boat. When the valves are closed, the piston, and hence the marine drive, is locked in position. Propeller torque or other forces imposed on the marine drive are transferred to the boat rather than to the control cable and the steering wheel. To steer the marine drive, the control cable initially opens the valves in the piston, unlocking the marine drive. Thereafter it moves the marine drive to the desired position. A lost motion mechanism, including that used in a vane steering system, may be utilized for this purpose. Alternately, the piston may lock the lost motion mechanism rather than the marine drive, to prevent the transmission of forces to the steering wheel.

3 Claims, 9 Drawing Figures

NO-FEEDBACK STEERING SYSTEM FOR MARINE DRIVES

The present invention relates to a steering system by which loads originating in a marine drive are not supplied, or "fed back", to the helm of the boat. The result is a reduction in the steering effort required by the operator to maintain the boat on course. The steering system of the present invention may be used in conjunction with a steering control having a steering vane to reduce operator steering effort needed to turn the boat.

The present invention is suitable for use in steerable marine drives of the inboard-outboard stern drive or outboard motor type in which the drive is turned or steered to alter the course of the boat. The steering control for such marine drives typically includes a control cable connecting the steering wheel at the helm in the front of the boat to the marine drive at the back of the boat.

A major portion of the operation of boats, including those powered with steerable marine drives, does not require turning, the boat being operated on a straight course. However, such operation does require steering effort on the part of the operator to maintain the desired course, as for example, to resist propeller torques or other forces exerted on the steering control. If not resisted by the operator, such forces will act on the marine drive and steering control to turn the marine drive and steering wheel. The boat is thus diverted from the desired course. This reverse action in which forces, such as propeller torque originating in the marine drive, operate the steering control, rather than vice versa, has been characterized as "feedback".

Various techniques have come under consideration for reducing or eliminating feedback and the resistance required by the operator to maintain the boat on course. For example, a worm gear may be incorporated in the steering control between the steering wheel and the steering cable so that forces applied to the marine drive will not be applied to the wheel. The worm gear also locks the drive in the steering position established by the helm. However, such gearing tends to be more complex and expensive than the conventional rack and pinion gearing used in steering controls. In another approach, hydraulically assisted power steering may be employed in the steering control to reduce operator steering effort. Power steering may increase the cost of the steering control even more.

It is, therefore, the object of the present invention to provide an improved steering system for marine drives that both eliminates the return or feedback of forces originating in the marine drive to the steering wheel and retains the marine drive in the desired steering position without intervention by the operator.

It is known to reduce the operator effort required to turn a marine drive by means of a rotatable steering vane mounted on the submerged portions of the marine drive. The hydrodynamic forces generated upon rotating the vane turn the marine drive with a corresponding reduction of effort on the part of the operator. In the event the steering vane cannot provide steering of sufficient magnitude or rapidity, the drive unit can be turned directly from the steering control.

It is a further object of the present invention to provide an improved steering system having the features described above that lends itself to incorportion in a steering control utilizing a steering vane, thereby to reduce operator effort required to turn the marine drive.

Briefly, the present invention contemplates a steering system having a movement control means with relatively movable elements. The movement control means may comprise a fluid-filled, hydraulic cylinder with the housing and piston comprising the elements. The housing is fastened to the boat. The piston is fastened to the steering arm of the marine drive. The piston contains a valving arrangement for transferring fluid from one side of the piston to the other. The valving is operated from the steering control.

When the valving is closed, the piston, and hence the steering arm and marine drive cannot move. The marine drive is thus locked in position. Any forces imposed on the marine drive are transferred to the housing and ultimately to the boat, rather than to the steering control and the operator.

To steer the marine drive, the steering control initially opens the valving in the piston, unlocking the marine drive, and thereafter moves the marine drive to the desired steering position. The steering control may be connected to the steering arm through a lost motion mechanism for this purpose.

If the marine drive vane steering system incorporates a lost motion mechanism between the steering control and the steering arm for operating the vane, the same lost motion mechanism may be used for both the steering vane and the steering system of the present invention.

Alternatively, the piston can lock the lost motion mechanism rather than the steering arm, to prevent the transmission of forces to the operator at the helm.

The invention will be further understood by the following description taken in conjunction with the drawing. In the drawing.

Figure 1:
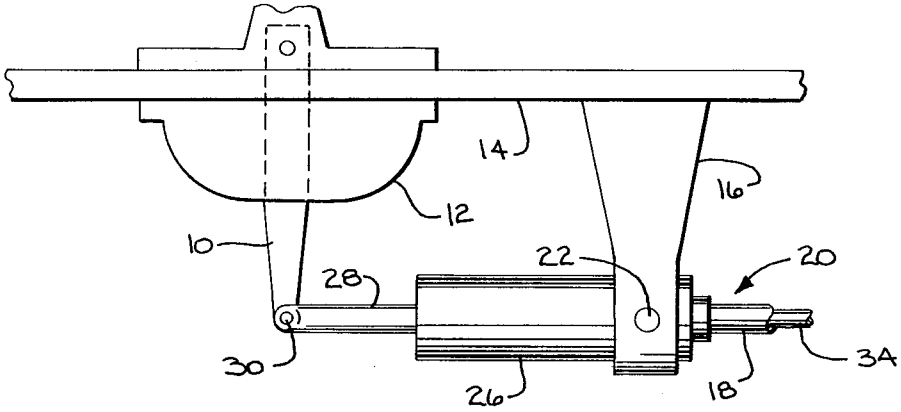
FIG. 1 is a diagrammatic plan view of the steering system of the present invention.

In FIG. 1, the numeral 10 indicates a steering arm of a marine drive 12, such as an inboard-outboard stern drive or an outboard motor. Steering arm 10 is located adjacent transom 14 of the boat.

Figure 2:
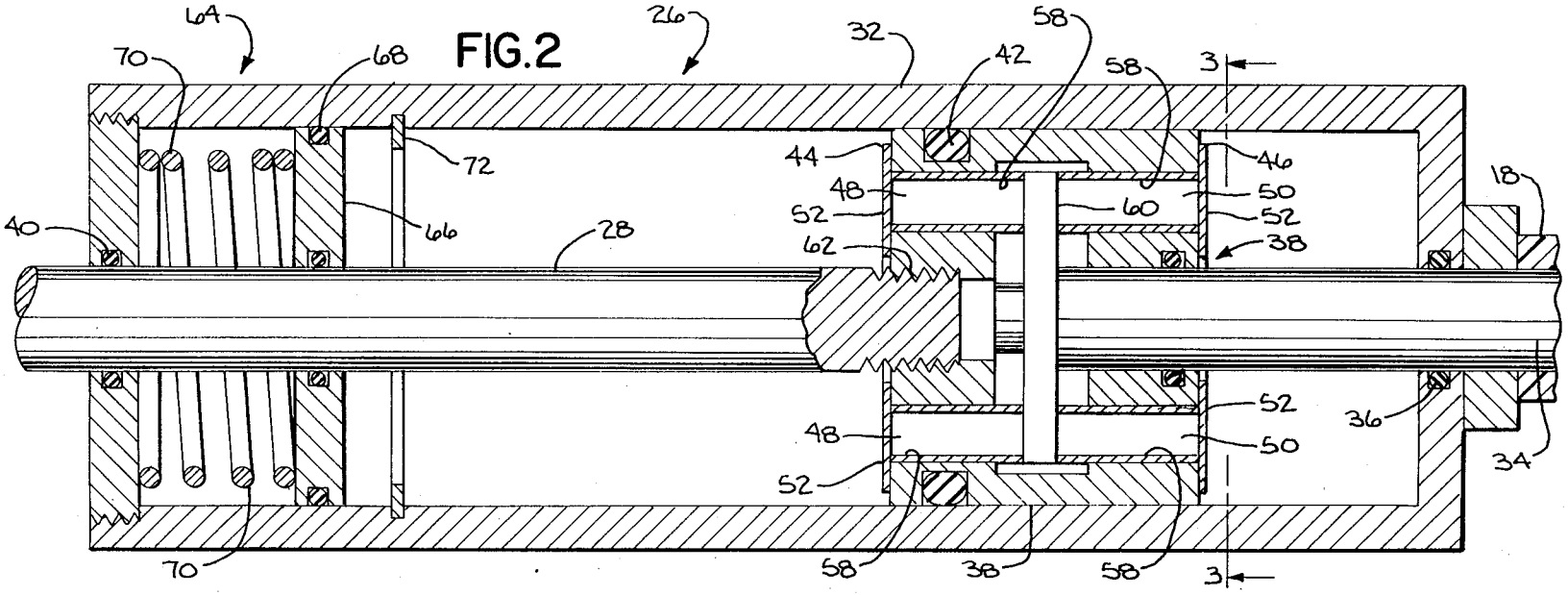
FIG. 2 is a detailed cross-sectional view of the hydraulic cylinder, movement control element of the steering system of FIG. 1, showing the element in one operative condition.

Bracket 16 extends from transom 14. No-feedback hydraulic cylinder 26, shown in detail in FIG. 2, is secured to bracket 16 at pivot 22. The casing 18 of steering cable 20 is fastened to no-feedback cylinder 26. Steering ram 28 extending from cylinder 26 is connected to steering arm 10 by pin 30. The pivotal mounting of cylinder 26 on bracket 16 accommodates the arcuate movement of steering arm 10.

No-feedback cylinder 26 includes housing 32 fastened to bracket 16. Core 34 of steering cable 18 extends through seal 36 into the interior of hydraulic cylinder 26, generally along its axis, and is coupled to piston 38. Steering ram 28 is connected to piston 38 and extends through seal 40 out the other end of hydraulic cylinder 26 for connection to steering arm 10. Housing 32 is filled with hydraulic fluid on both sides of piston 38.

Figure 3:
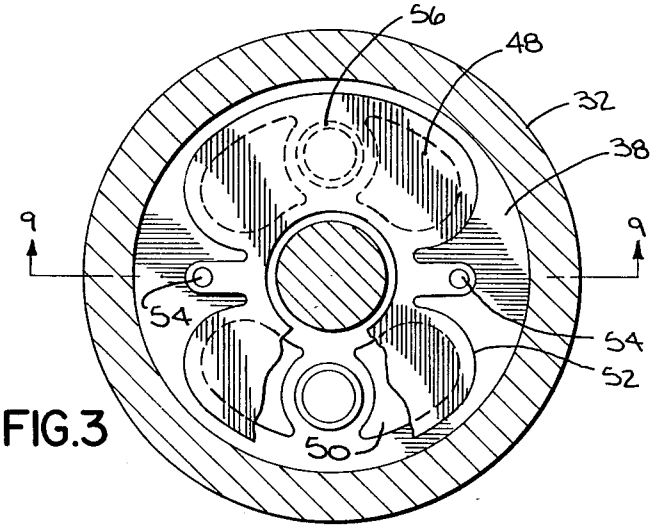
FIG. 3 is a cross-sectional view taken along the line 3—3 of FIG. 2.

Piston 38 comprises a hollow body having a seal 42 along the interior of housing 32. The end faces 44 and 46 of piston 38 contains valve ports 48 and 50, respectively. As shown in FIG. 3, ports 48 and 50 may be arcuate or kidney shaped, if desired. A valve reed 52, mounted on the exterior of piston 38 and fastened as by rivets 54, covers each of ports 48 and 50. Cable core 34 and steering ram 28 may have the same diameter so that the end faces 44 and 46 exposed to the hydraulic fluid are the same area.

Bores 56 in piston 38 contain actuating rods 58 that may be formed as tubes. Actuating rods 58 can contact the interior surfaces of valve reeds 52 and unseat them from ports 48 and 50. Core 34 of steering cable 20 extends into the housing of piston 38 for movement with respect thereto. Transverse pin 60 passes through the end of core 34 so as to be positioned intermediate actuating rods 58, as shown in FIG. 2.

Steering ram 28 is fastened to piston 38 as by threading 62.

A high pressure accumulator 64 in hydraulic cylinder 28 is formed of partition 66 having edge seal 68. Spring 70 is compressed between the end of cylinder 28 and partition 66. Stop 72 projecting from the interior of cylinder 28 limits the travel of partition 66. Accumulator 64 pressurizes the fluid in cylinder 28 to compensate for thermal expansion and contraction in the cylinder. The pressurized fluid assists in sealing valve reeds 52 on ports 48 and 50.

In operation, when no-feedback cylinder 26 is in the neutral condition shown in FIGS. 2 and 3, valve reeds 52 are seated on ports 48 and 50. With ports 48 and 50 sealed, piston 38 is incapable of moving with respect to housing 32 since the fluid in the housing cannot be transferred from one side of the piston to the other. As piston 38 is locked against movement with respect to housing 32 anchored to transom 14 by bracket 16, steering ram 28 and steering arm 10 are similarly locked against movement. This holds marine drive 12 against any movement due to propeller torques or other forces exerted on it. Any forces generated by steering arm 10 are absorbed by the fluid, housing 32, and ultimately bracket 16 and transom 14 and not by core 34 of steering cable 20 connected to the steering wheel. The marine drive 12 is thus retained in the desired steering position without requiring any resistance to be exerted by the operator on the steering wheel.

Figure 4:
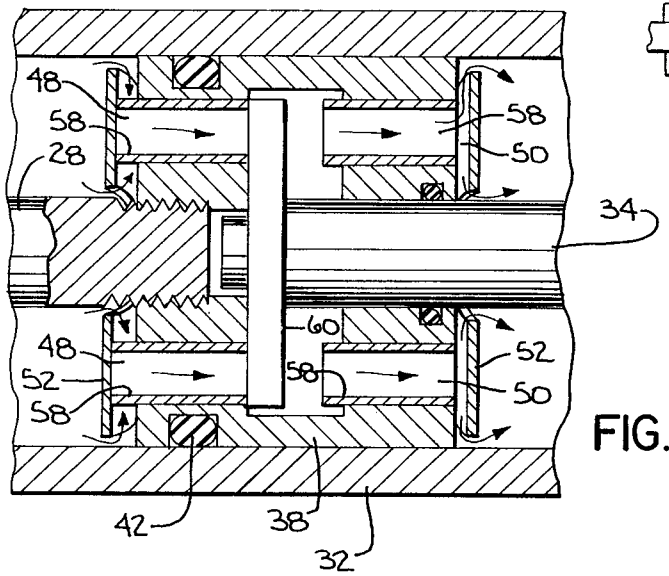
FIG. 4 is a fragmentary detailed view similar to FIG. 2 showing the hydraulic cylinder in another operative condition.

When it is desired to turn marine drive 12 with respect to transom 14, for example, in the clockwise direction, the core 34 of steering cable 20 is moved by the steering wheel to extend it to the left, as shown in FIG. 4. This movement causes pin 60 to strike actuating rod 58 to unseat valve reed 52 from port 48. Hydraulic fluid can now flow through port 48, the interior of piston 38, and out valve port 50. This allows piston 38 and steering ram 28 to move to the left to rotate steering arm 10 and marine drive 12 in the clockwise direction to steer the boat. When marine drive 12 has moved to the desired position, pin 60 will release actuating rod 58, causing valve reed 52 to seal port 48. This locks marine drive 12 in the new position.

To steer marine drive 12 in the counterclockwise direction, the operation of the steering system and no-feedback cylinder 26 is reversed.

Figure 5:
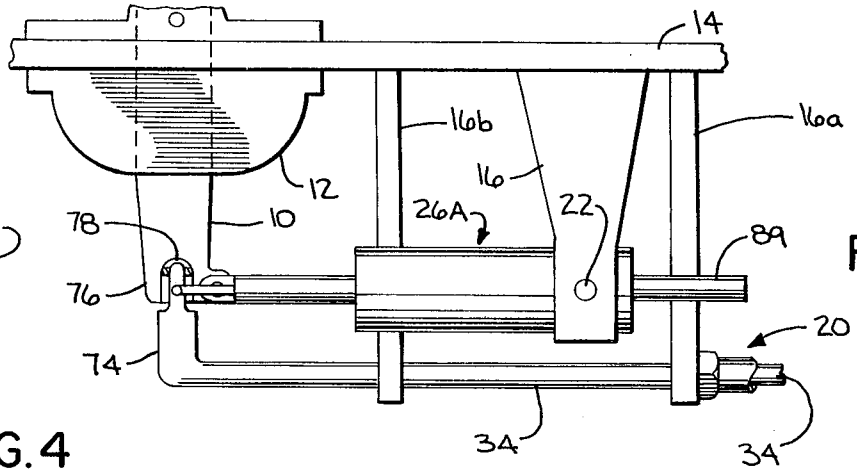
FIG. 5 is a diagrammatic plan view similar to FIG. 1 showing another embodiment of the steering system of the present invention.
Figure 6:
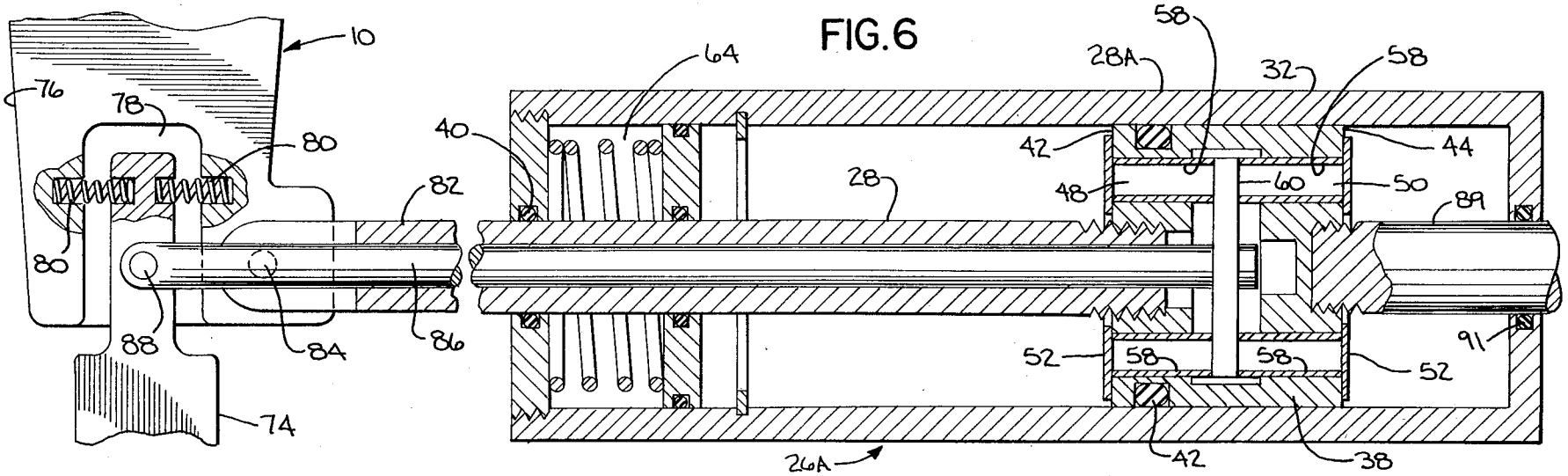
FIG. 6 is a detailed cross-sectional view of the steering system shown in FIG. 5.

It may be desired to connect steering cable 20 directly to steering arm 10 rather than through the coupling provided by piston 38 and hydraulic cylinder 26, as shown in FIG. 2. This may afford the certainty of a mechanical connection and other advantages. The embodiment of the invention shown in FIGS. 5 and 6 provides such a connection. Steering cable 20 is mounted to transom 14 by brackets **16*a*, 16*b*. Core 34 of steering cable 20 extends through brackets 16*a* and 16*b* and is formed to lever 74 at its terminus. The end of lever 74 extends into fork 76 on steering arm 10 with clearance 78. Lever 74 may be centered in fork 76 by springs 80 set in recesses in lever 74 and steering arm fork 76**.

No-feedback cylinder 26A may be pivotally mounted on bracket 16 in the same manner as cylinder 26 shown in FIG. 1. The construction of no-feedback cylinder 26A is generally the same as hydraulic cylinder 28 shown in FIGS. 2, 3, and 4. However, steering arm 10 is coupled to piston 38 by hollow tube 82. For this purpose, tube 82 may be pinned to steering arm 10 by pin 84. Tube 82 contains push rod 86. Push rod 86 is connected to lever 74 at one end by pin 88. The other end of push rod 86 contains pin 60. The valving structure of piston 38 of hydraulic cylinder 26A may resemble that described in detail above in connection with FIGS. 2, 3, and 4.

Rod 89 extends from face 44 of piston 38 out of cylinder 26A through seal 91 to equalize the areas of faces 42 and 44.

In operation, no-feedback hydraulic cylinder 26A is shown in the neutral condition in FIG. 6 with valve reeds 52 seated on ports 48 and 50. Piston 38 and steering arm 10 are locked against movement and any forces generated by steering arm 10 are absorbed by cylinder 26A and not core 34 of steering cable 20 and the operator.

When core 34 of steering cable 20 is moved by the steering wheel to turn marine drive 12, lever 74 can move independently of steering arm 10 by the amount of clearance 78. The movement of lever arm 78 moves push rod 86, causing pin 60 to open one or the other of ports 48 or 50. This unlocks piston 38 so that when lever 74 engages fork 76 on steering arm 10, core 34 may move the steering arm and marine drive 12.

With the embodiment of the invention shown in FIG. 5, a mechanical connection is provided between steering cable 20 and steering arm 10 while at the same time, the no-feedback features of hydraulic cylinder 26A are made available. The pressurization of cylinder 26A by spring 70 in accumulator 64 provides a centering action that permits the elimination of springs 80 if desired.

The no-feedback features of the steering system of the present invention reduce the operator effort required to hold the marine drive to the desired steering position. The steering system of the present invention may be combined with the use of a steering vane that reduces operator effort required to turn the marine drive from one steering position to another.

Figure 7:
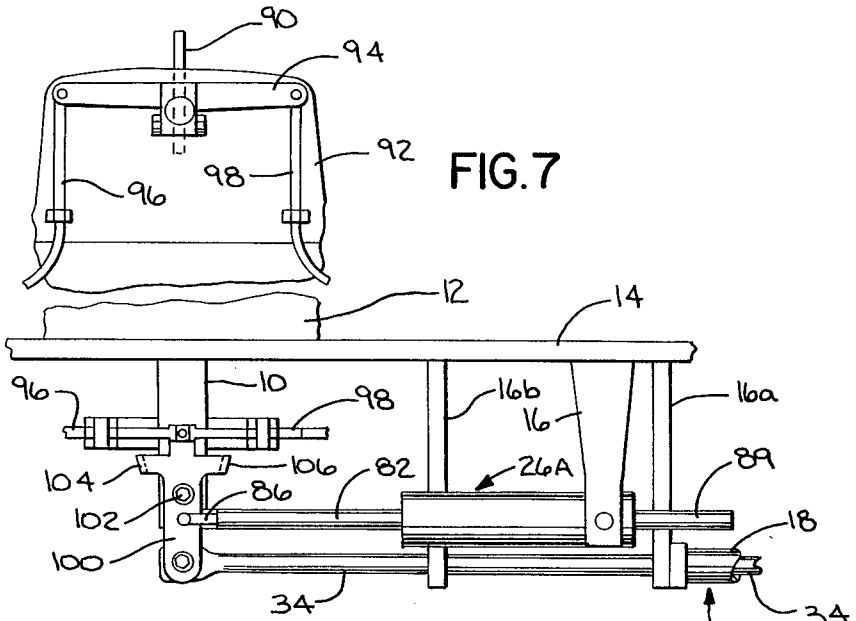
FIG. 7 is a diagrammatic plan view similar to FIGS. 1 and 5 showing the steering system of the present invention modified for use with a steering control having a steering vane.

A steering system of this type is shown in FIG. 7 and is described in detail in U.S. Pat. No. 4,349,341 to Morgan, et al, U.S. Pat. No. 2,993,464 to Conover, U.S. Pat. No. 3,943,878 to Kirkwood, et al, and others. Steering vane 90 is mounted on the submersible portions of the marine drive, such as anti-cavitation plate 92. A steering bar 94 is mounted to vane 90. One end of a vane steering cable 96, 98 is mounted to each extremity of steering bar 94. The other ends of vane steering cables 96 and 98 are mounted to lever 100 pivotally mounted on steering arm 10 at point 102. Lever 100 contains arms that include stops 104 and 106 abutting with the steering arm. The steering cable core 34 is mounted to the end of lever 100. Pivot point 102 is intermediate the attachment of cables 96 and 98 and the attachment of steering cable core 34.

To steer the boat with steering vane 90, the steering vane is moved in the same direction as it is desired to turn the boat and opposite to the necessary turning of marine drive 12. For example, to steer the boat to left or to port, i.e. to swing the bow in the counterclockwise direction, steering vane 90 must be rotated in the counterclockwise direction. The counterclockwise direction of steering vane 90 generates a hydrodynamic force on marine drive 12 that rotates the marine drive in the clockwise direction. This turns the bow of the boat in the counterclockwise direction.

To obtain the above described operation, the steering wheel of the steering control is operated to extend steering cable core 34, or move it to the left, when viewed as in FIG. 7. This rotates lever 100 in the clockwise direction. The movement of lever 100 causes a pull in cable 96 and a push in cable 98 that rotates steering vane 90 in the counterclockwise direction. The hydrodynamic forces generated on marine drive 12 by the rotation of vane 90 rotate marine drive 12 in the clockwise direction. This provides the desired counterclockwise course deviation to the boat.

In the event steering vane 90 cannot provide steering to marine drive 12 of sufficient magnitude or rapidity, lever 100 is rotated to the point at which one or the other of stops 104 and 106 will contact steering arm 10. This causes steering cable core 34 to directly move steering arm 10 and marine drive 12.

As shown in FIG. 7, no-feedback hydraulic cylinder 26A is mounted on transom 14 by bracket 16A. Tube 82 is connected to steering arm 10 by a pin in the same manner as shown in FIG. 5. Push rod 86 is connected to lever arm 100 between the attachment of steering cable core 34 and pivot point 102 so that movement of lever arm 100 relative to steering arm 10 by steering cable core 34 moves push rod 86. This relative or "lost" motion operates the appropriate valves in piston 38 to unlock hydraulic cylinder 26A and allow movement of steering arm 10 and marine drive 12 responsive to the action of steering vane 90, or the action of steering cable core 34, lever arm 100, and stops 104, 106.

Figure 8:
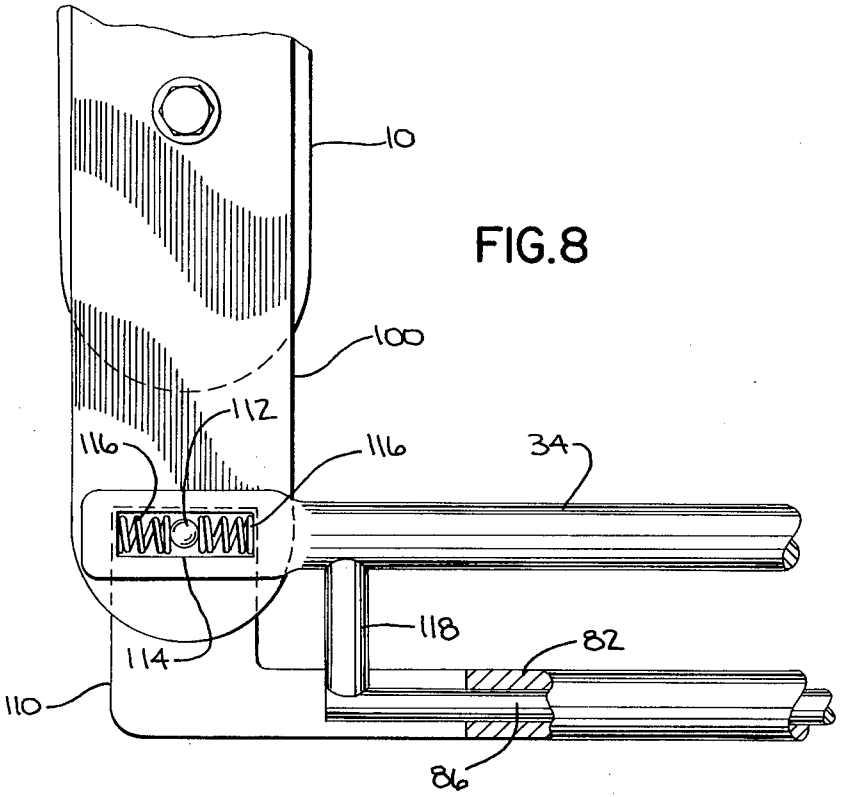
FIG. 8 is a fragmentary view showing another embodiment of the steering system of the present invention suitable for use with a steering control having a steering vane.

The no-feedback steering system shown in FIG. 7 locks steering arm 10 in the same manner as the steering system shown in FIG. 6. However, it is also possible to lock the end of lever 100 to which steering cable core 34 is connected, rather than steering arm 10. This embodiment of the invention is shown in FIG. 8.

Arm 110 is connected to tube 82 of a no-feedback cylinder 26A that may be the same as the no-feedback cylinder shown in FIG. 6. One end of bolt 112 in the end of lever 100 extends through arm 110 without play. Arm 110 may be positioned beneath lever 100. Steering cable core 34 embraces the other end of bolt 112 at slot 114. Steering cable core 34 may be positioned above lever 100. Bolt 112 may be centered in slot 114 by springs 116.

Steering cable core 34 is connected to push rod 86 by link 118. The remaining portions of lever 100 and marine drive 12 resemble those shown in FIG. 7.

Slot 114 provides sufficient relative or "lost" motion to steering cable core 34 with respect to the arm 110 and tube 82 to operate link 118 and push rod 86 so that the no-feedback cylinder 26A may be unlocked, permitting turning of marine drive 12 by the steering vane or by steering cable core 34.

With the embodiment shown in FIG. 8, as with the other embodiments of the invention, steering cable core 34 and the steering control is protected against the feedback of forces from marine drive 12. However, since it is bolt 112 that is locked against movement when piston 38 is in the locked condition, rather than steering arm 10, marine drive 12 can move to the extent permitted by stops 104 and 106 on lever arm 100.

Figure 9:
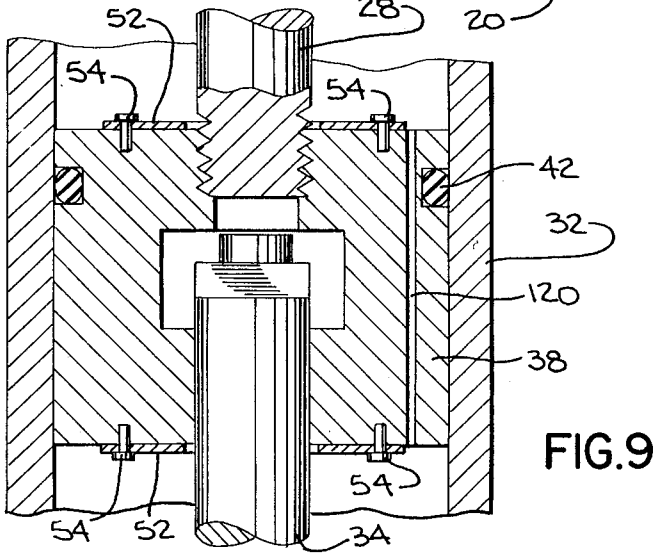
FIG. 9 is a cross-sectional view of the piston element taken along the line 9—9 of FIG. 3 and showing a modification of the piston.

FIG. 9 shows a piston 38 having a continuously open bleed port 120. This allows movement of piston 38 even when ports 48 and 50 are sealed by valve reeds 52. Bleed port 120 permits a small amount of feedback to the steering control and some steering feel to the operator.

While the steering system of the present invention has been shown and described as having a housing 32 connected to bracket 16 and transom 14, and steering arm 28 or tube 82 connected to steering arm 10 or link 100, it will be appreciated that these elements may be reversed in position, if desired.

Various modes of carrying out the invention are contemplated as being within the scope of the following claims particularly pointing out and distinctly claiming the subject matter which is regarded as the invention.

I claim:

1. In a steering control for a steerable marine drive mounted on a boat and having a steering arm, said steering control having steering means movable by the operator of the boat, an improved steering system for limiting the application of forces on the marine drive to the steering means and for restraining the marine drive to a desired steering position, said steering system comprising:

a hydraulic cylinder anchored to one of said steering arm and said boat;

a piston axially movable in said cylinder and defining first and second chambers on first and second axially distal ends thereof within said cylinder, said piston having an axial communication passage therethrough providing communication of hydraulic fluid between said chambers;

a first axial shaft in said cylinder rigidly connecting said piston to the other of said steering arm and said boat;

said operator steering means comprising a second axial shaft in said cylinder; and first and second valve means on said piston radially outboard of said shafts and each normally closed against hydraulic pressure in a respective one of said first and second chambers to block said axial communication passage and lock said piston in place in said cylinder, each said valve means being actuatable to an open condition against said hydraulic pressure in its respective said first or second chamber, wherein said first valve means is mechanically opened by said second shaft in response to a first direction axial movement of said second shaft, and said second valve means is opened by hydraulic pressure from said first chamber communicated through said opened first valve means and through said axial communication passage in said piston;

and wherein said second valve means is mechanically opened by said second shaft in response to a second direction axial movement of said second shaft, and said first valve means is opened by hydraulic pressure from said second chamber communicated through said opened second valve means and through the same said axial communication passage in said piston.

2. In a steering control for a steerable marine drive mounted on a boat and having a steering arm, said steering control having steering means movable by the operator of the boat, an improved steering system for limiting the application of forces on the marine drive to the steering means and for restraining the marine drive to a desired steering position, said steering system comprising:

a hydraulic cylinder anchored to one of said steering arm and said boat;

a piston axially movable in said cylinder and defining first and second chambers on first and second axially distal ends thereof within said cylinder, said piston having an axial communication passage therethrough providing communication of hydraulic fluid between said chambers;

a first axial shaft in said cylinder rigidly connecting said piston to the other of said steering arm and said boat;

valve means on said piston for closing said axial communication passage to lock said piston in place in said cylinder, and for opening said passage to permit axial movement of said piston; and said operator steering means comprising a second axial shaft in said cylinder mechanically actuating said valve means from a point axially interior of said piston between said axially distal ends, wherein said valve means comprises first and second valves at respective said first and second axially distal ends of said piston, and wherein each of said valves is normally closed against hydraulic pressure in its respective said chamber and is opened by hydraulic pressure in said axial communication passage from the other said chamber.

3. The invention according to claim 2 wherein said axial communication passage is radially outboard of said shafts, and comprising transverse pin means connected to said second shaft axially interior of said piston and extending radially outboard of said shafts and into said axial communication passage, said transverse pin means mechanically opening said first valve through a first axial actuating rod within said axial communication passage in said piston in response to axial movement of said second shaft in a first direction, the same said transverse pin means mechanically opening said second valve through a second axial actuating rod within said axial communication passage in said piston in response to axial movement of said second shaft in a second direction.

* * * * *